US008297438B2

(12) United States Patent
Crossman

(10) Patent No.: US 8,297,438 B2
(45) Date of Patent: Oct. 30, 2012

(54) MULTIPACK CARRIER FOR PACKAGING CONTAINERS

(76) Inventor: Stephen Arthur Crossman, Laval (CA)

( * ) Notice: Subject to any disclaimer, the term of this patent is extended or adjusted under 35 U.S.C. 154(b) by 0 days.

(21) Appl. No.: 13/430,682

(22) Filed: Mar. 26, 2012

(65) Prior Publication Data

US 2012/0241332 A1 Sep. 27, 2012

Related U.S. Application Data

(60) Provisional application No. 61/467,441, filed on Mar. 25, 2011.

(51) Int. Cl.
*B65D 75/00* (2006.01)

(52) U.S. Cl. ..... 206/174; 206/199

(58) Field of Classification Search ..... 206/170, 206/174, 199, 145, 147, 148, 149, 150, 151, 206/152, 153, 158, 159, 161, 427
See application file for complete search history.

(56) References Cited

U.S. PATENT DOCUMENTS

| | | | | |
|---|---|---|---|---|
| 5,590,776 | A * | 1/1997 | Galbierz et al. | 206/427 |
| 5,746,310 | A * | 5/1998 | Slomski | 206/150 |
| 5,791,463 | A * | 8/1998 | Negelen | 206/147 |
| 7,108,128 | B2 * | 9/2006 | Borg | 206/150 |
| 2009/0101662 | A1 * | 4/2009 | Marco et al. | 220/737 |

* cited by examiner

*Primary Examiner* — Jacob K Ackun
(74) *Attorney, Agent, or Firm* — Sinorica, LLC

(57) ABSTRACT

A multipack carrier for packaging containers is an apparatus that is used to hold, bundle, and transport packaging containers together. The packaging containers is any kind of bottle, can, or jar that is used to store consumer goods. The apparatus comprises of a plurality of plastic braces, a paper board carrier, a grasping mechanism, and a printed graphic. The plastic braces allows the apparatus to clutch each individual packing containers, and the paper board carrier allows the apparatus to simultaneous support all of the plastic braces. In the preferred embodiment, the plastic braces are created by injecting recyclable resin into a plastic injection mold and onto the paper board carrier. The printed graphic can be illustrated on the apparatus because of the material of the paper board carrier. The grasping mechanism allows a person to pick up and carry the apparatus with the packing containers.

18 Claims, 12 Drawing Sheets

MULTIPACK CARRIER FOR PACKAGING CONTAINERS

The current application claims a priority to the U.S. Provisional Patent application Ser. No. 61/467,441 filed on Mar. 25, 2011. The current application filed in U.S. Mar. 26, 2012 while Mar. 25, 2012 was on a weekend.

FIELD OF THE INVENTION

The present invention relates generally to an apparatus for carrying beverage containers. More particularly, the present invention provides an environmentally safe and structurally secure carrying case for beverage containers, including but not limited to bottles.

BACKGROUND OF THE INVENTION

As consumers and governments apply more pressure on retailers to reduce their packaging content and ecological imprint, there is an existing market looking to purchase alternate forms of packaging that address these new concerns. The present invention addresses these concerns. The present invention is manufactured from recycled material and is ecological friendly. The present invention will add value and enhance the overall appearance of the product(s) while providing added value. The present invention is safe and easy to manufacture using existing machinery and is comfortable to the user. The innovative material construction and design allow the combination of recycled fiber board, and the option of including high quality graphics, enhancing the image of the brand and increasing shelf exposure together with the performance properties of plastic resin. The present invention will be adopted quickly into the marketplace as it addresses retailers and manufacturers green initiatives and is functional in the market place. The cost of the present invention is comparative to other types of carriers in the market today. Furthermore, the present invention is made from recycled materials and is totally recyclable.

Multipack carriers are widely used in big box and club stores to provide a convenient method of holding, displaying, and carrying multiple bottles and cans together. They are available in a wide assortment of styles and shapes to fit a wide assortment of container sizes and configurations. Examples are two bottle, three bottle and six pack format. Certain models, referred to as on-pack attachments, are used to affix sample bottle(s) to larger host bottles for testers and promotional giveaways. These are frequently used by fast-moving consumer-goods manufacturers and distillers to provide a means to attach a smaller, sampler size portion to a larger host bottle and are not usually designed to be used as a carrying device.

Multi-pack carriers and on-pack attachments consist primarily of plastic injection molded carriers that slip over the neck of a bottle(s) and apply a locking feature that provides enough resistance under the rib, present in most bottle or container necks just under where the cap bottoms on the bottle or under the top lip in the case of canned goods. Each product poses a unique nesting requirement according to the style of the bottleneck, diameter of the bottle or container and the number of bottles or containers that make up the value pack. In addition to injection molding, certain manufacturers fabricate these items using plastic sheeting and then form them into the various styles using very high cost dies.

The two most common methods of creating multipack carriers and on-pack attachments has its drawbacks since it is not cost effective to print graphics on the carrier leaving the presentation somewhat neutral. When retailers require UPC labels, which is often the case, labels are printed and are affixed to the surface of the carrier as a secondary operation typically by hand or with automated equipment.

The present invention and on-pack attachment addresses the concerns of retailers, brand managers, and consumers alike. With retailers constantly adding pressure to vendors to come up with more environmentally friendly packaging alternatives, the present invention would fill a natural demand in the market place. In addition, the option of incorporating colorful graphics into the packaging design will add interest to the marketing and advertising departments of brand owners, allowing them to look at the product not only as a raw cost but also as a marketing tool, enabling them to allocate a portion of their marketing budget into the formula.

The present invention is totally recyclable and made from 100% recycled materials. The present invention is an ecological carrier attachment used to display and carry several bottles, cans, or jugs. The carrier attachment slips over the neck(s) of bottles or cans and provides a secure method of displaying products at retail, in addition to enabling customers an easy method to pick up the items. Carrier attachments are designed to hold two or more bottles or containers of equal or different sizes, and are secured by way of recyclable fiberboard carriers with over-molded closures designed to fit the various styles and sizes of bottle necks and containers.

This device is innovative as it helps address retailers and manufacturers recent initiatives to decrease the environmental impact of their packaging. It is manufactured from ecological materials like multi-layered recycled paper, non toxic inks, and recyclable plastic resins. The present invention is printable with safe soy based inks for promoting advertising, ingredients or contents, contests, and a UPC code. The new design and construction offers the strength, recyclability and printability of a multi-layered recycled paper fiber board in addition to the detail and performance characteristics of recycled plastic resin. The present invention is constructed from fiberboard and the detailed closures are over-molded recycled plastic resin. The shape of the EGMC varies with the number, shape and size of the bottles or containers it is designed to hold. The over-molded plastic resin closures are available in three basic design constructions and various sizes to reflect the different sizes of bottle necks and containers available in the marketplace.

DETAIL DESCRIPTIONS OF THE INVENTION

Figure 1:
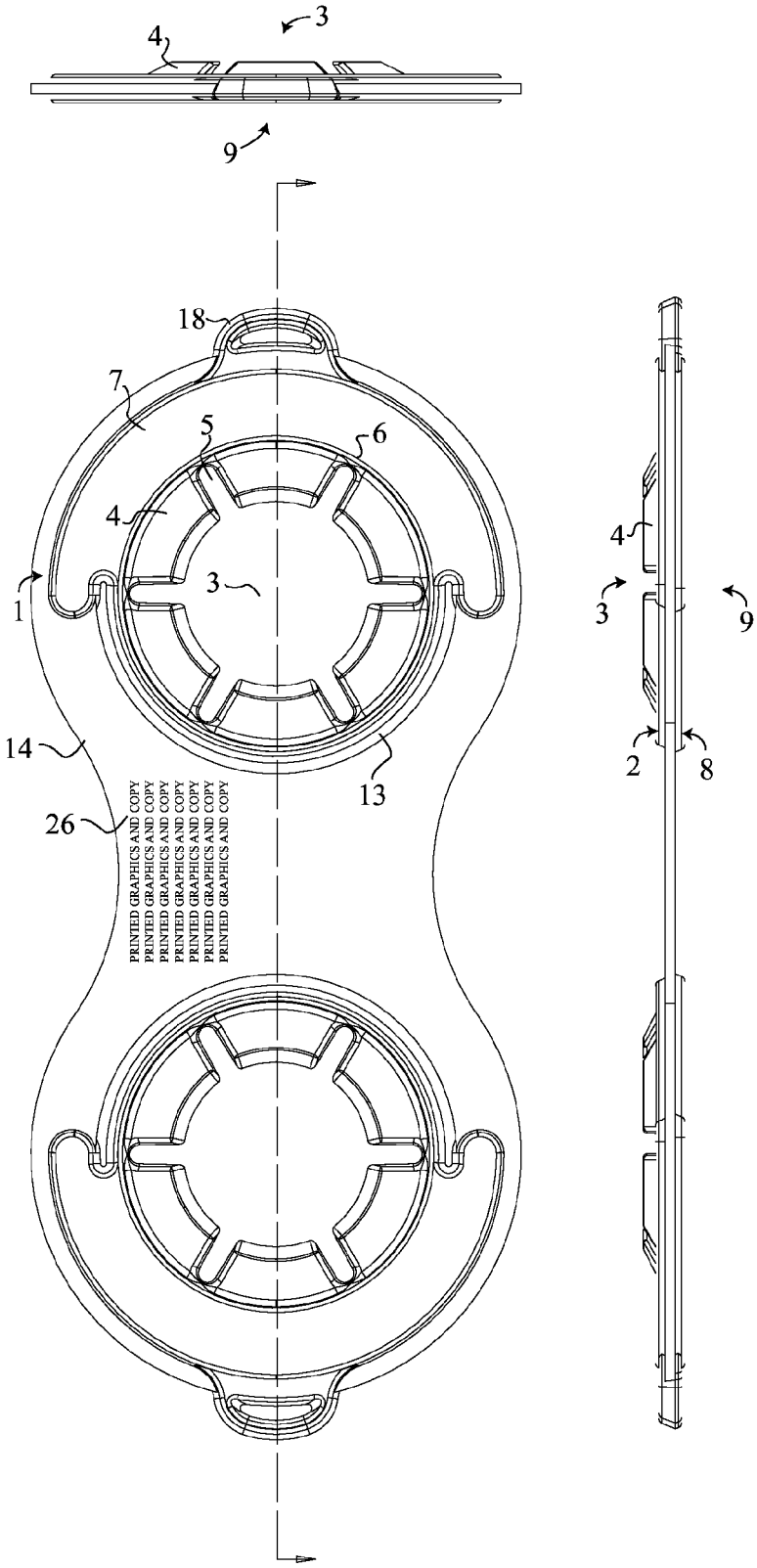
FIG. 1 is a number of different views for the present invention in one embodiment, where the top adhesion arc and bottom adhesion arc are half of a circle, the plastic braces have a flex slit, and the gripping mechanism has plastic handle bars.
Figure 2:
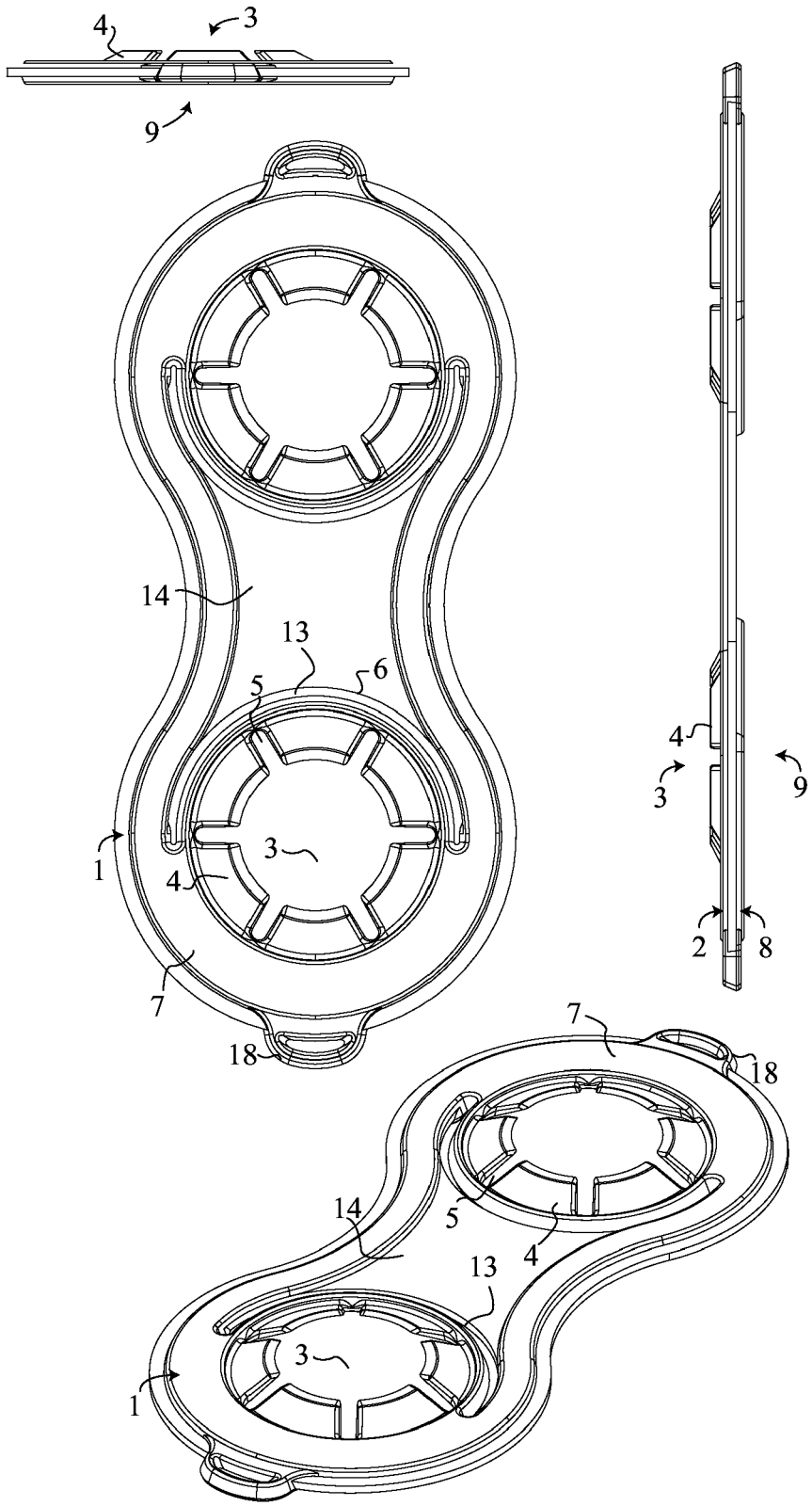
FIG. 2 is a number of different views for the present invention in a similar embodiment to that shown in FIG. 1, but this embodiment has plastic supports running in between the plastic braces.
Figure 3:
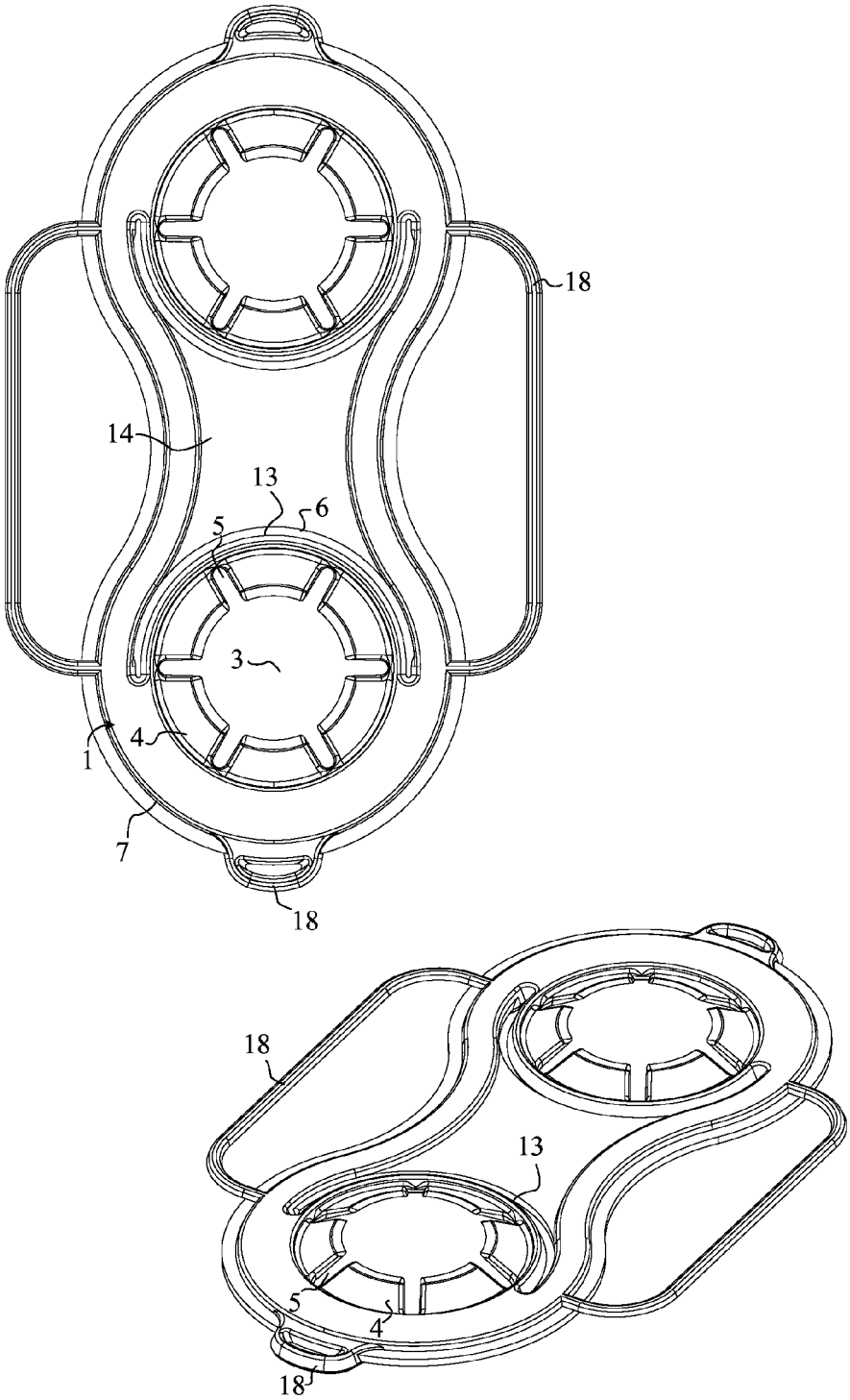
FIG. 3 is a number of different views for the present invention in a similar embodiment to that shown in FIG. 2, but this embodiment has plastic handle bars protruding from the plastic braces.
Figure 4:
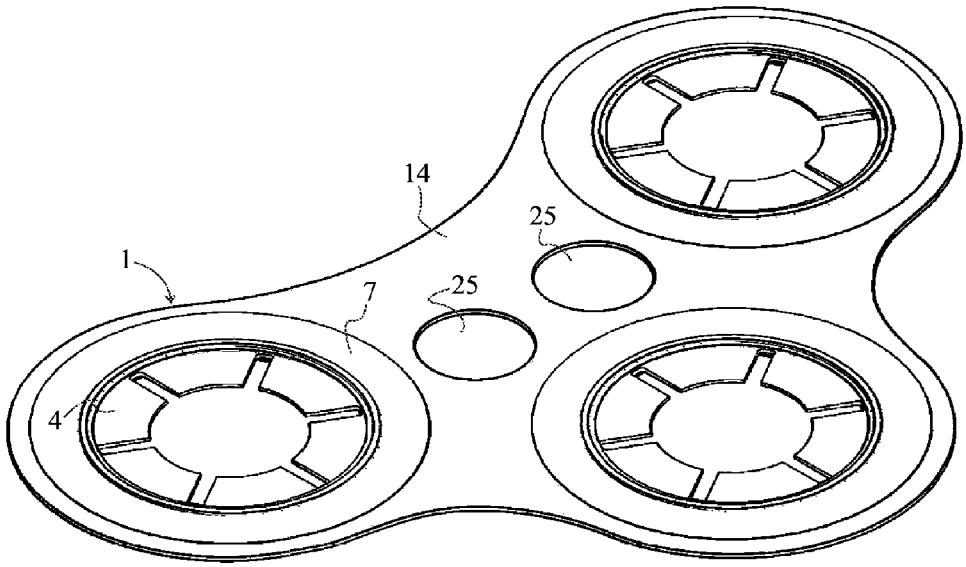
FIG. 4 is a perspective view for the present invention in another embodiment, where the top adhesion arc and the bottom adhesion arc are a full circle, the plastic braces do not have a flex slit, and the gripping mechanism has finger holes.
Figure 5:
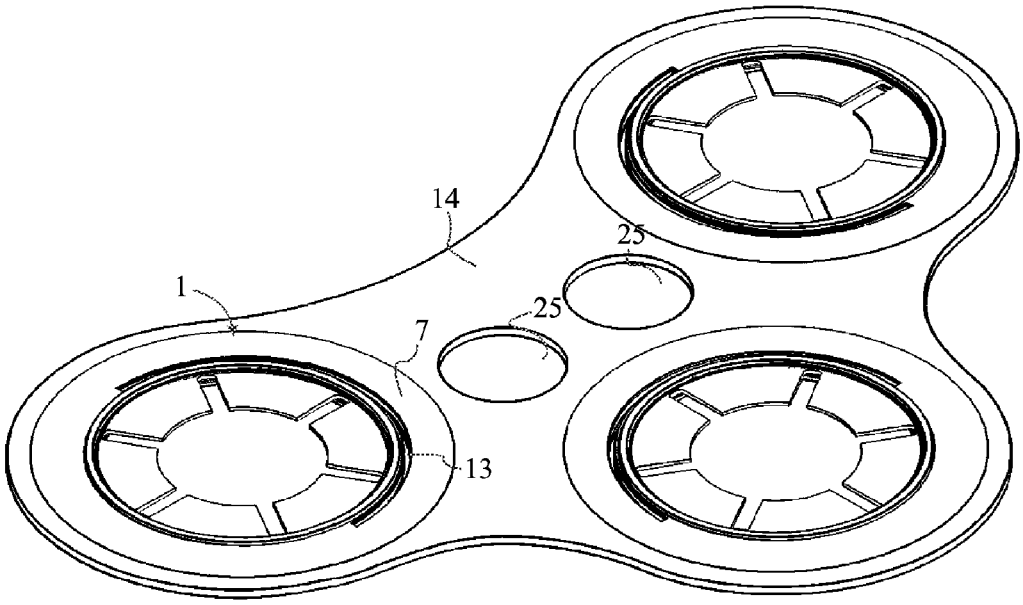
FIG. 5 is a perspective view for the present invention in a similar embodiment to that shown in FIG. 4, but the plastic braces do have a flex slit.
Figure 6:
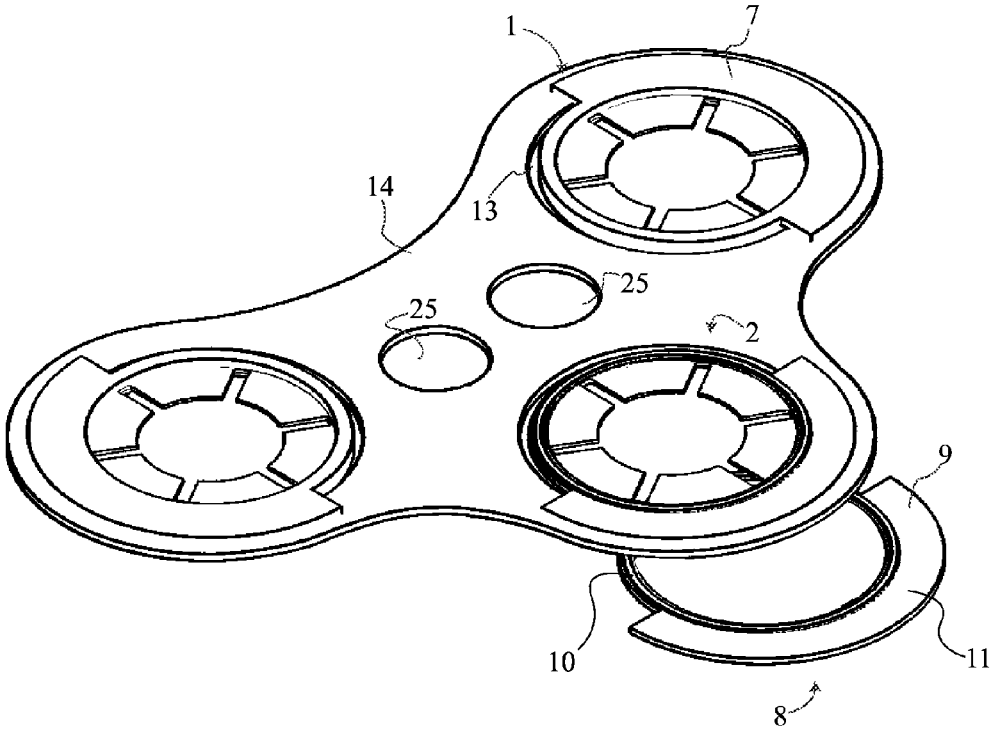
FIG. 6 is a perspective view of the present invention in a similar embodiment to that shown in FIG. 5, but the top adhesion arc and the bottom adhesion arc are half of a circle.
Figure 7:
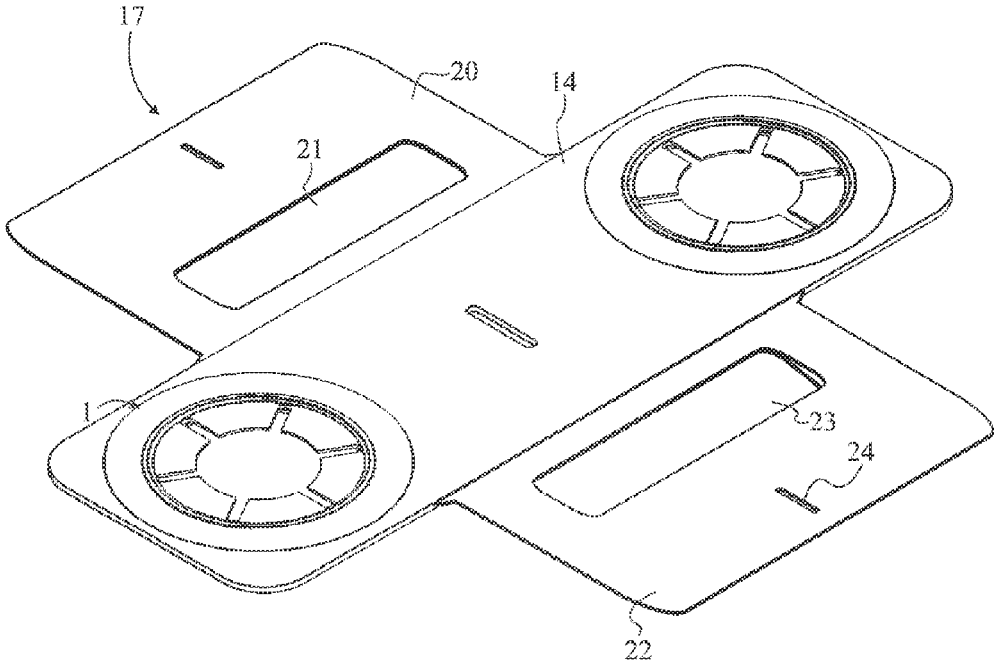
FIG. 7 is a perspective view of the present invention in another embodiment, where the top adhesion arc and the bottom adhesion arc are a full circle, the plastic braces do not have a flex slit, and the gripping mechanism has flaps and hand holes.
Figure 8:
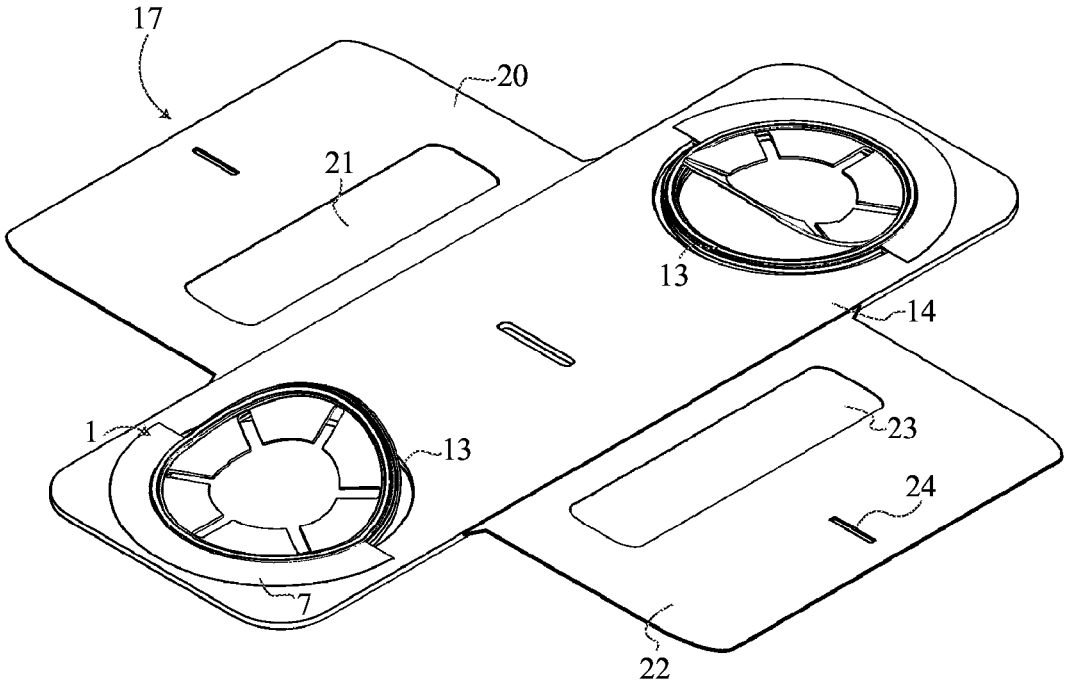
FIG. 8 is a perspective view of the present invention in a similar embodiment to that shown in FIG. 7, but the top adhesion arc and the bottom adhesion arc are half of a circle, the plastic braces do have a flex slit, and the plastic braces show how they can be contorted.
Figure 9:
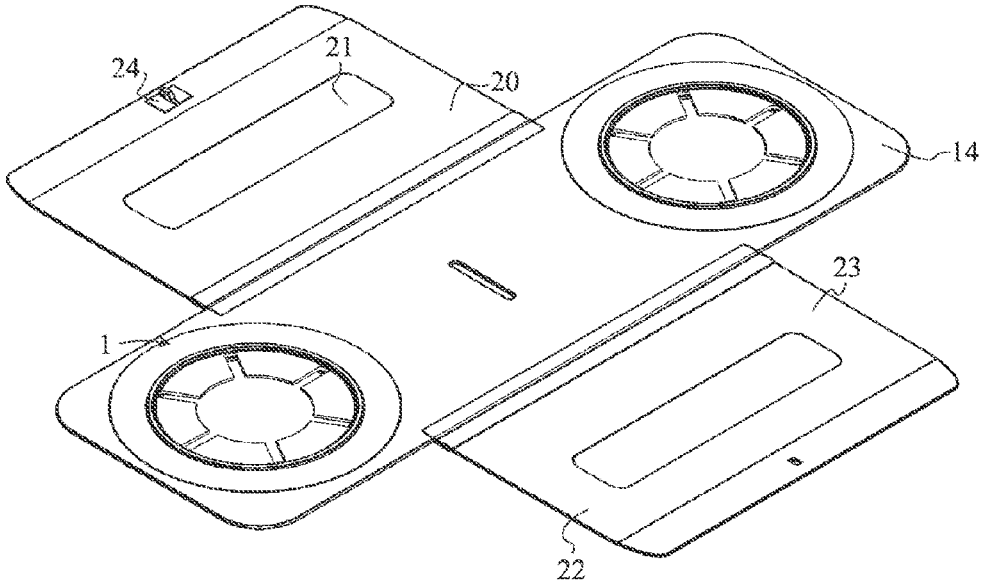
FIG. 9 is a perspective view of the present invention in a similar embodiment to that shown in FIG. 7, but the flaps are connected to the paper board carrier by plastic hinges.
Figure 10:
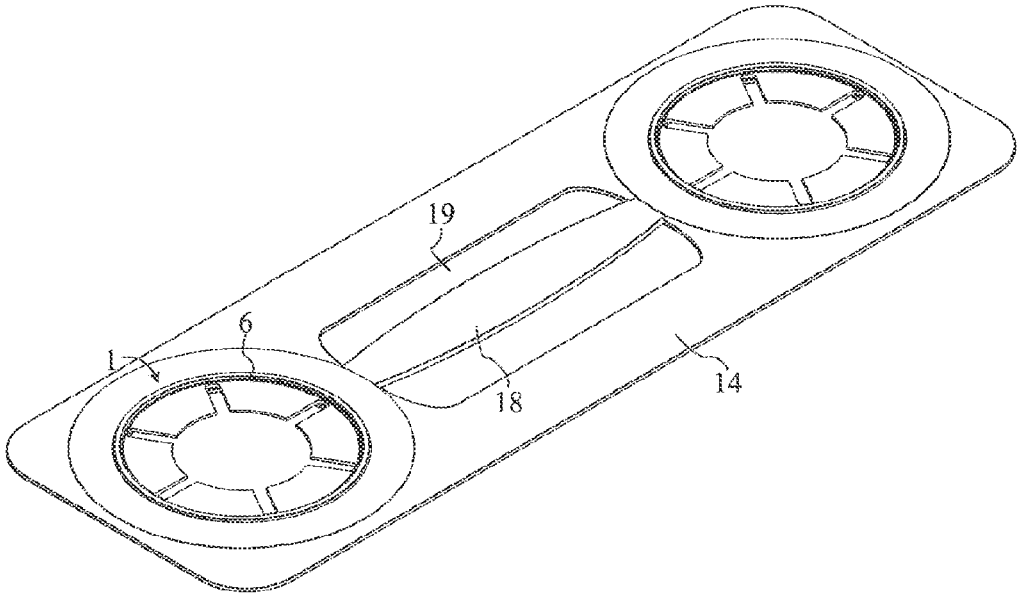
FIG. 10 is a perspective view of the present invention in another embodiment, where the top adhesion arc and the bottom adhesion arc are a full circle, the plastic braces do not have a flex slit, and the gripping mechanism has a plastic handle bar and a handle bar hole.
Figure 11:
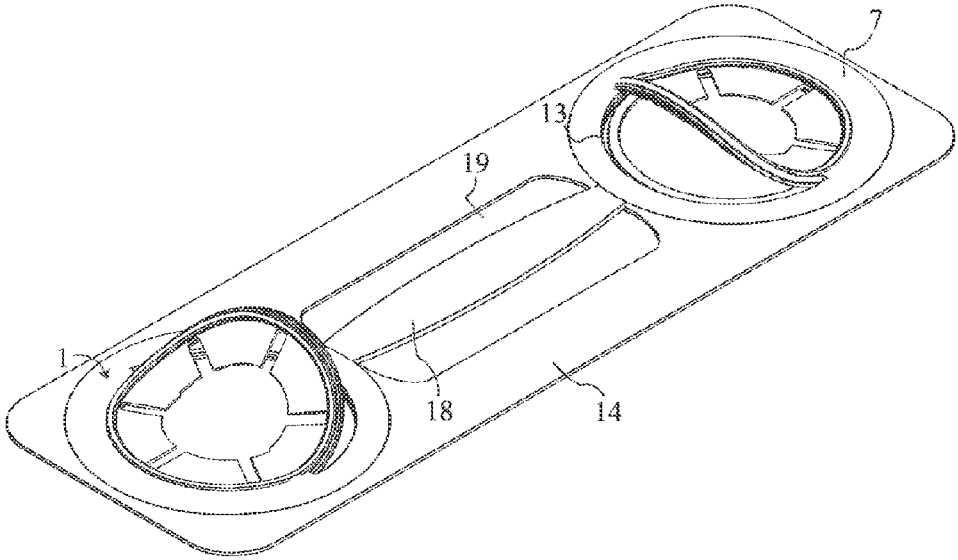
FIG. 11 is a perspective view of the present invention in a similar embodiment to that shown in FIG. 10, but the plastic braces have a flex slit and the plastic braces show how they can be contorted.
Figure 12:
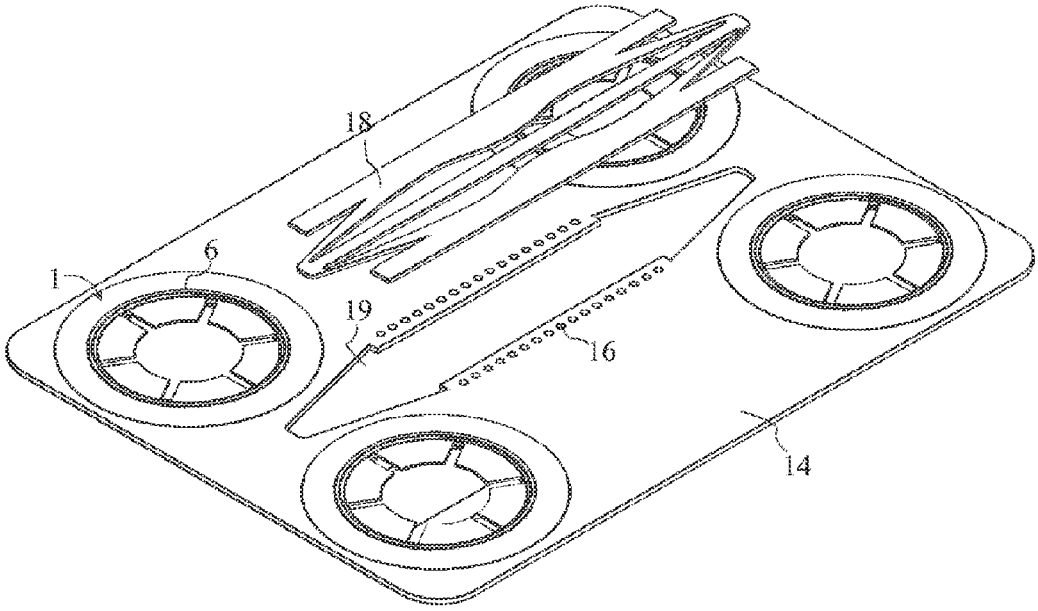
FIG. 12 is a perspective view of the present invention in another embodiment, where the top adhesion arc and the bottom adhesion arc are a full circle, the plastic braces do not have a flex slit, and the gripping mechanism has a plastic handle bar and a handle bar hole.

All illustrations of the drawings are for the purpose of describing selected versions of the present invention and are not intended to limit the scope of the present invention.

The present invention is a multipack carrier for packaging containers, which is used to hold, bundle, and transport the packaging containers together. The packaging containers can be any kind or style of bottle, can, or jar that could be used to store consumer goods such as, but not limited to, ketchup bottles, soda cans, or detergent containers. The present invention comprises a plurality of plastic braces 1, a paper board carrier 14, a grasping mechanism 17, and a printed graphic 26. Each of the plastic braces 1 is used to clutch an individual packaging container. The number of plastic braces 1 depends on how many packaging containers that a manufacturer or a seller wants to package together. For example, the present invention could include six plastic braces 1 to form a six-pack carrier or could include eight plastic braces 1 to form an eight-pack carrier. In the preferred embodiment of the present invention, the plastic braces 1 are created by inserting a prefabricated paper board carrier 14 into a specially designed plastic injection mold and by injecting a recyclable plastic resin into the plastic injection mold. The recyclable resin is a material that provides the present invention with the strength and performance characteristics to adequately support the packaging containers in critical contact areas. The paper board carrier 14 provides the present invention with a means to hold the plurality of plastic braces 1 together. The paper board carrier 14 can be cut and shaped in any size to accommodate any number of the plastic braces 1. In the preferred embodiment, the paper board carrier 14 is created by laminating multiple layers of recycled paper fibers with new paper fibers and by bonding the recycled paper fibers and the new paper fibers together with resin or starch adhesives under high pressure. The recycled paper fibers are a material that provides the present invention with the strength and versatility characteristics to adequately position and support the plurality of plastic braces 1. The material of the paper board carrier 14 also allows the printed graphic 26 to be illustrated onto the paper board carrier 14. In the preferred embodiment, the printed graphic 26 can be a logo, an advertising message, or an universal product code (UPC), which could be either imprinted on directly onto the paper board carrier 14 or printed on the paper material of the paper board carrier 14 before laminating, die-cutting, and over-molding the paper board carrier 14. If the printed graphic 26 includes the UPC for the packaging containers, then that eliminates the need for the manufacturer to put a printed UPC label on the packaging containers. The grasping mechanism 17 allows a person to lift and carry the present invention with the packaging containers. The grasping mechanism 17 is properly positioned on the paper board carrier 14 so that the weight of the packaging containers is evenly distributed throughout the present invention as the present invention is being picked up or carried by a person.

The paper board carrier 14 provides the present invention with the structure to properly support the plurality of plastic braces 1 and the packaging containers. The paper board carrier 14 comprises a plurality of brace holes 15 and a plurality of adhesion holes 16. The brace holes 15 traverse through the paper board carrier 14, which allows a packaging container to pass through the paper board carrier 14 once the packaging container is attached to a plastic brace 1. Each of the plurality of plastic braces 1 is concentrically positioned within one of the brace holes 15. The number of brace holes 15 on the paper board carrier 14 determines the number of plastic braces 1 for the present invention. The adhesion holes 16 also traverse through the paper board carrier 14 and are positioned around each of the brace holes 15 so that each plastic brace 1 can connect to one of the brace holes 15 through the paper board carrier 14. In the preferred embodiment of the present invention, the recyclable resin flows into the injection mold and through the adhesion holes 16 in order to form one of the plastic braces 1.

The plurality of plastic braces 1 allows the present invention to firmly clutch each individual packaging container. Each of the plurality of plastic braces 1 comprises a top portion 2, a bottom portion 8, an adhesive 12, and a flex slit 13. The top portion 2 and the bottom portion 8 are used to properly position specific features onto a plastic brace. The paper board carrier 14 is positioned in between the top portion 2 and the bottom portion 8 for each of the plastic braces 1. The adhesive 12 is used to connect the top portion 2 to the bottom portion 8 through the adhesion holes 16. In the preferred embodiment of the present invention, the recyclable resin flows into the injection mold, which is designed to accommodate the shape of the paper board carrier 14 while its cavities are used to create the shape of the top portion 2 and the bottom portion 8. The top portion 2 comprises a neck hole 3, a plurality of contact extensions 4, a plurality of separation slits 5, a raised rib 6, and a top adhesion arc 7. The neck hole 3 is located at the center of the top portion 2 and allows a packaging container to be inserted into a plastic brace 1. The neck hole 3 is delineated by the contact extensions 4, which are used to laterally support a packaging container. The end of each contact extension 4 is cut and shaped so that each contact extension 4 is able to maximize the contact area with the packaging container. The contact extensions 4 are radially positioned around the neck hole 3 so that the contact extensions 4 evenly brace the packaging container. The width, the length, and the thickness of the contact extensions 4 are designed to accommodate the size and the weight of the packaging container and its contents. The separation slits 5 are located in between the contact extensions 4 and divide the contact extension into flexible slits. The separation slits 5 allows the contact extensions 4 to flex as the packaging container is inserted into a plastic brace 1 and allows the contact extension 4 to revert back to its original position once the packaging container is secured by the plastic brace 1. The contact extensions 4 can also be angled upward so that the contact extensions 4 do not slump downwards from the weight of the packing container and its contents and, thus, eventually release the packaging container from the plastic brace. The raised rim is positioned concentrically around the neck hole 3 and the contact extensions 4, which allows the contact extensions 4 to be connected to the raised rim opposite to the neck hole 3. The raised rim provides the contact extensions 4 with the structure to adequately support the packaging container. The top adhesion arc 7 is concentrically connected around the raised rib 6 and is the area of the top portion 2 that the adhesive 12 uses to connect the top portion 2 to the bottom portion 8. The top adhesion arc 7 can be designed to be a portion of the circumference of a circle. For example, the top adhesion arc 7 can be half of a ring or a full ring that is positioned concentrically around the raised rib 6. In addition, the top adhesion arc 7 allows the top portion 2 of the plastic brace 1 to support the weight of the packing container against the paper board carrier 14.

The bottom portion 8 is used more to adequately situate the plastic brace 1 on the packaging container while the present invention is not being picked up or carried by a person. The bottom portion 8 comprises a nesting hole 9, a recessed rib 10, and a bottom adhesion arc 11. The nesting hole 9 is located at the center of the bottom portion 8. The nesting hole 9 encompasses the neck hole 3 and the contact extensions 4 for the top portion 2 and allows the packing container to traverse through the bottom portion 8. The nesting hole 9 is delineated by the recessed rib 10, which is concentrically positioned below the raised rib 6 so that the raised rib 6 can engage the recessed rib 10 when the top portion 2 is connected to the bottom portion 8. The bottom adhesion arc 11 is concentrically connected around the recessed rib 10 and is the area of the bottom portion 8 that the adhesive 12 uses to connect the bottom portion 8 to the top portion 2. The bottom adhesion arc 11 is similar to the top adhesion arc 7 in that the bottom adhesion arc 11 can also be designed to be a portion of the circumference of a circle. Likewise, the bottom adhesion arc 11 allows the top portion 2 of the plastic brace 1 to support the weight of the packing container against the paper board carrier 14.

When the top portion 2 and the bottom portion 8 are connected to each other, the bottom adhesion arc 11 is concentrically positioned below the top adhesion arc 7. In addition, the top adhesion arc 7 of each plastic brace 1 is positioned above the adhesion holes 16 for each of the plastic braces 1, and the bottom adhesion arc 11 of each plastic brace 1 is positioned below the adhesion holes 16 for each of the plastic braces 1. This allows the top adhesion arc 7 to be connected to the bottom adhesion arc 11 by the adhesive 12. In the preferred embodiment of the present invention, the recyclable resin flows from top adhesion arc 7, through the adhesion holes 16, and into the bottom adhesion arc 11 as a plastic brace 1 is being formed within the injection mold.

The flex slit 13 allows the plastic brace 1 to contort in such a way that the packing container remains plumb when a person picks up or carries the present invention. The flex slit 13 is concentrically positioned around the raised rib 6 and the recessed rib 10 and, thus, has a semicircular shape, which allows half of the raised rib 6, half of the recessed rib 10, and half of the contact extensions 4 to bend as the weight of the package container bears down the plastic brace. The flex slit 13 traverses through both the top portion 2 and the bottom portion 8 so that the entire plastic brace 1 can bend. The flex slit 13 is positioned adjacent to the raised rib 6 and the recessed rib 10 so that the top adhesion arc 7 and the bottom adhesion arc 11 do not bend and are solely used to stabilize the plastic brace 1 on the paper board carrier 14. In one embodiment of the present invention, the flex slit 13 is just part of a gap between the edge of a plastic brace 1 and the edge of a brace hole 15, which occurs when the top adhesion arc 7 and the bottom adhesion arc 11 is half of a ring. Finally, the flex slit 13 for each of the plastic braces 1 are oriented towards each other, which evenly distributes the weight of the packaging containers while each of the plastic braces 1 are bending to keep all of the packaging containers plumb to the ground.

The grasping mechanism 17 allows the user to pick up and carry the present invention while the plastic braces 1 are clutching the packaging containers. The prevent invention can utilize different kinds of grasping mechanisms 17. One kind of grasping mechanism 17 would comprise a plurality of finger holes 25. The finger holes 25 would positioned adjacent to each other and would traverse through the paper board carrier 14. The plurality of finger holes 25 would allow the person to pick up or carry the present invention by inserting their fingers through the finger holes 25 and holding the paper board carrier 14. Another kind of grasping mechanism 17 would comprise a first flap 20, a first hand hole 21, a second flap 22, a second hand hole 23, and a locking device 24. The first flap 20 would be adjacently and rotatably connected to the paper board carrier 14, and the second flap 22 would be adjacently and rotatably connected to the paper board carrier 14 opposite to the first flap 20. This would allows the first flap 20 and the second flap 22 to fold towards each other. The first flap 20 could be attached to the second flap 22 by the locking device 24 opposite to the paper board carrier 14. The locking device 24 is anything that holds the top of the first flap 20 to the top of the second flap 22 such as a clip or a tab that is inserted into a slit. The first hand hole 21 traverses through the first flap 20, and the second hand hole 23 traverses through the second flap 22. The first hand hole 21 and the second hand hole 23 are positioned in between the locking device 24 and the paper board carrier 14 and are concentrically positioned to each other, which allows a person to pick up or carry the present invention by placing their hand through the first hand hole 21 and the second hand hole 23 and by grasping the first flap 20 and the second flap 22. Another kind of grasping mechanism 17 would comprise at least one plastic handle bar 18, which a person could grasp while picking up or carrying the present invention. The plastic handle bar 18 would be connected to the top adhesion arc 7 in between the plastic braces 1. In preferred embodiment of the present invention, the recyclable resin would flow into an injection mold that has a portion to create the plastic handle bar 18. In one version, the grasping mechanism 17 has two plastic handle bars 18 that extend over the edge of the paper board carrier 14. In another version, the grasping mechanism 17 further comprises a handle bar hole 19, which traverses through the paper board carrier 14. In this version, the plastic handle bar 18 is connected to all of the plastic braces 1 and is positioned over the handle bar hole 19. Thus, a person can curl their hand through the handle bar hole 19 in order to grasp the plastic handle bar 18 so that the person can pick up or carry the present invention.

Although the invention has been explained in relation to its preferred embodiment, it is to be understood that many other possible modifications and variations can be made without departing from the spirit and scope of the invention as hereinafter claimed.

What is claimed is:

1. A multipack carrier for packaging containers comprises, a plurality of plastic braces;

a paper board carrier;

a grasping mechanism;

a printed graphic;

each of said plurality of plastic braces comprises a top portion, a bottom portion, an adhesive, and a flex slit;

said paper board carrier comprises a plurality of brace holes and a plurality of adhesion holes;

said top portion comprises a neck hole, a plurality of contact extensions, a plurality of separation slits, a raised rib, and a top adhesion arc;

said bottom portion comprises a nesting hole, a recessed rib, and a bottom adhesion arc;

each of said plurality of plastic braces being concentrically positioned along said plurality of brace holes;

said paper board carrier being positioned in between said top portion and said bottom portion for each of said plurality of plastic braces; and said adhesive traversing through said plurality of adhesion holes in order to connect said top portion and said bottom portion to said paper board carrier.

2. The multipack carrier for packaging containers as claimed in claim 1 comprises, said plurality of brace holes and said plurality of adhesion holes traversing through said paper board carrier, wherein said paper board carrier is designed, constructed, and diecut before the plurality of plastic braces are injection molded onto the paper board carrier;

said plurality of adhesion holes being positioned around each of said plurality of brace holes;

said top adhesion arc for each of said plurality of plastic braces being positioned above said plurality of adhesion holes for each of said plurality of brace holes; and said bottom adhesion arc being positioned above said plurality of adhesion hole for each of said plurality of brace holes.

3. The multipack carrier for packaging containers as claimed in claim 2 comprises, said top adhesion arc being connected to said bottom adhesion arc by said adhesive, wherein said paper board carrier is inserted in an injection mold that is designed to accommodate said paper board carrier and cavities for said top portion and said bottom portion.

4. The multipack carrier for packaging containers as claimed in claim 1 comprises, said neck hole being delineated by said plurality of contact extensions;

said plurality of contact extensions being radially positioned around said neck hole;

said plurality of separation silts being located in between said plurality of contact extensions;

said raised rib being concentrically positioned around said neck hole and said plurality of contact extensions;

each of said plurality of contact extensions being connected said raised rib opposite to said neck hole;

said top adhesion arc being concentrically connected around said raised rib;

said nesting hole being delineated by said recessed rim;

said recessed rim being concentrically positioned below said raised rim;

said bottom adhesion arc being concentrically connected around said recessed rim; and said bottom adhesion arc being concentrically positioned below said top adhesion arc.

5. The multipack carrier for packaging containers as claimed in claim 1 comprises, said flex slit being concentrically positioned around said raised rib and said recessed rib;

said flex slit being positioned adjacent to said raised rib and said recessed rib;

said flex slit traversing through said top portion and said bottom portion; and said flex slit for each of said plurality of plastic braces being oriented towards each other.

6. The multipack carrier for packaging containers as claimed in claim 1 comprises, said grasping mechanism comprises a plurality of finger holes;

said plurality of finger holes being positioned adjacent to each other; and said plurality of finger holes traversing through said paper board carrier.

7. A multipack carrier for packaging containers comprises, a plurality of plastic braces;

a paper board carrier;

a grasping mechanism;

a printed graphic;

each of said plurality of plastic braces comprises a top portion, a bottom portion, an adhesive, and a flex slit;

said paper board carrier comprises a plurality of brace holes and a plurality of adhesion holes;

said top portion comprises a neck hole, a plurality of contact extensions, a plurality of separation slits, a raised rib, and a top adhesion arc;

said bottom portion comprises a nesting hole, a recessed rib, and a bottom adhesion arc;

each of said plurality of plastic braces being concentrically positioned along said plurality of brace holes;

said paper board carrier being positioned in between said top portion and said bottom portion for each of said plurality of plastic braces; and said adhesive traversing through said plurality of adhesion holes in order to connect said top portion and said bottom portion to said paper board carrier.

8. The multipack carrier for packaging containers as claimed in claim 7 comprises, said plurality of brace holes and said plurality of adhesion holes traversing through said paper board carrier, wherein said paper board carrier is designed, constructed, and diecut before the plurality of plastic braces are injection molded onto the paper board carrier;

said plurality of adhesion holes being positioned around each of said plurality of brace holes;

said top adhesion arc for each of said plurality of plastic braces being positioned above said plurality of adhesion holes for each of said plurality of brace holes; and said bottom adhesion arc being positioned above said plurality of adhesion hole for each of said plurality of brace holes.

9. The multipack carrier for packaging containers as claimed in claim 8 comprises, said top adhesion arc being connected to said bottom adhesion arc by said adhesive, wherein said paper board carrier is inserted in an injection mold that is designed to accommodate said paper board carrier and cavities for said top portion and said bottom portion.

10. The multipack carrier for packaging containers as claimed in claim 7 comprises, said neck hole being delineated by said plurality of contact extensions;

said plurality of contact extensions being radially positioned around said neck hole;

said plurality of separation silts being located in between said plurality of contact extensions;

said raised rib being concentrically positioned around said neck hole and said plurality of contact extensions;

each of said plurality of contact extensions being connected said raised rib opposite to said neck hole;

said top adhesion arc being concentrically connected around said raised rib;

said nesting hole being delineated by said recessed rim;

said recessed rim being concentrically positioned below said raised rim;

said bottom adhesion arc being concentrically connected around said recessed rim; and said bottom adhesion arc being concentrically positioned below said top adhesion arc.

11. The multipack carrier for packaging containers as claimed in claim 7 comprises, said flex slit being concentrically positioned around said raised rib and said recessed rib;

said flex slit being positioned adjacent to said raised rib and said recessed rib;

said flex slit traversing through said top portion and said bottom portion; and said flex slit for each of said plurality of plastic braces being oriented towards each other.

12. The multipack carrier for packaging containers as claimed in claim 7 comprises, said grasping mechanism comprises a first flap, a second flap, a first hand hole, a second hand hole, and a locking device;

said first flap being rotatably connected adjacent to said paper board carrier;

said second flap being rotatably connected adjacent to said to said paper board carrier opposite to said first flap;

said first flap being attached to said second flap by said locking device opposite to said paper board carrier;

said first hand hole traversing through said first flap;

said second hand hole traversing through said second flap;

said first hand hole and said second hand hole being positioned in between said paper board carrier and said locking mechanism; and said first hand hole and said second hand hole being concentrically positioned to each other.

13. A multipack carrier for packaging containers comprises, a plurality of plastic braces;

a paper board carrier;

a grasping mechanism;

a printed graphic;

each of said plurality of plastic braces comprises a top portion, a bottom portion, an adhesive, and a flex slit;

said paper board carrier comprises a plurality of brace holes and a plurality of adhesion holes;

said top portion comprises a neck hole, a plurality of contact extensions, a plurality of separation slits, a raised rib, and a top adhesion arc;

said bottom portion comprises a nesting hole, a recessed rib, and a bottom adhesion arc;

each of said plurality of plastic braces being concentrically positioned along said plurality of brace holes;

said paper board carrier being positioned in between said top portion and said bottom portion for each of said plurality of plastic braces; and said adhesive traversing through said plurality of adhesion holes in order to connect said top portion and said bottom portion to said paper board carrier.

14. The multipack carrier for packaging containers as claimed in claim 13 comprises, said plurality of brace holes and said plurality of adhesion holes traversing through said paper board carrier, wherein said paper board carrier is designed, constructed, and diecut before the plurality of plastic braces are injection molded onto the paper board carrier;

said plurality of adhesion holes being positioned around each of said plurality of brace holes;

said top adhesion arc for each of said plurality of plastic braces being positioned above said plurality of adhesion holes for each of said plurality of brace holes; and said bottom adhesion arc being positioned above said plurality of adhesion hole for each of said plurality of brace holes.

15. The multipack carrier for packaging containers as claimed in claim 14 comprises, said top adhesion arc being connected to said bottom adhesion arc by said adhesive, wherein said paper board carrier is inserted in an injection mold that is designed to accommodate said paper board carrier and cavities for said top portion and said bottom portion.

16. The multipack carrier for packaging containers as claimed in claim 13 comprises, said neck hole being delineated by said plurality of contact extensions;

said plurality of contact extensions being radially positioned around said neck hole;

said plurality of separation silts being located in between said plurality of contact extensions;

said raised rib being concentrically positioned around said neck hole and said plurality of contact extensions;

each of said plurality of contact extensions being connected said raised rib opposite to said neck hole;

said top adhesion arc being concentrically connected around said raised rib;

said nesting hole being delineated by said recessed rim;

said recessed rim being concentrically positioned below said raised rim;

said bottom adhesion arc being concentrically connected around said recessed rim; and said bottom adhesion arc being concentrically positioned below said top adhesion arc.

17. The multipack carrier for packaging containers as claimed in claim 13 comprises, said flex slit being concentrically positioned around said raised rib and said recessed rib;

said flex slit being positioned adjacent to said raised rib and said recessed rib;

said flex slit traversing through said top portion and said bottom portion; and said flex slit for each of said plurality of plastic braces being oriented towards each other.

18. The multipack carrier for packaging containers as claimed in claim 13 comprises, said grasping mechanism comprises at least one plastic handle bar; and said plastic handle bar being connected to said top adhesion arc in between said plurality of plastic braces.

* * * * *